United States Patent [19]

Akasaka et al.

[11] Patent Number: 4,935,910

[45] Date of Patent: Jun. 19, 1990

[54] FITTING STRUCTURE FOR WATCH CASE AND BAND

[75] Inventors: Masayuki Akasaka; Makoto Kumagai, both of Tokyo, Japan

[73] Assignees: Hattori Seiko Co., Ltd.; Seiko Instruments Inc., both of Japan

[21] Appl. No.: 405,462

[22] Filed: Sep. 11, 1989

[30] Foreign Application Priority Data

Sep. 12, 1988 [JP] Japan ..... 63-119769[U]

[51] Int. Cl.[5] ..... G04B 37/00; A44C 5/00

[52] U.S. Cl. ..... 368/282; 224/164

[58] Field of Search ..... 368/281, 282; 224/167–180

[56] References Cited

U.S. PATENT DOCUMENTS 2,219,277 10/1940 Kaufmann ..... 368/282

4,561,077 12/1985 Mock et al. ..... 368/282

FOREIGN PATENT DOCUMENTS 0264875 4/1988 European Pat. Off. ..... 368/282

318900 3/1957 Switzerland ..... 368/282

*Primary Examiner*—Vit W. Miska

*Attorney, Agent, or Firm*—Bruce L. Adams; Van C. Wilks

[57] ABSTRACT

In fitting of a band to a wristwatch case; in order to minimize the gap at the area of fitting of these members, or pretend that a middle that constitutes the watch case is formed integral with the band and also to prevent excessive pivoting of the band relative to the watch case when the user wears the wristwatch, a recess for receiving the end portion of the band is formed in a part of the middle which is contiguous with each fitting portion where the band is fitted to the middle, thereby limiting the pivoting of the first link of the band by the inner wall of the recess. In addition, a projection is provided in the center of each of the fitting portions formed on the watch case to limit the pivoting of the second link of the band by the distal end of the projection.

3 Claims, 2 Drawing Sheets

FITTING STRUCTURE FOR WATCH CASE AND BAND

BACKGROUND OF THE INVENTION

The present invention relates to a fitting structure for a band and a case of a wristwatch.

FIG. 2 shows a conventional fitting structure for a wristwatch case and a band which is close to the present invention, in which a recess 4 for fitting a band is formed in the reverse side of a middle 1 that constitutes a watch and a band retaining member 3, for example, a spring bar, is retained at both ends within the recess 4, thereby coupling together the band and the watch case.

In the above-described prior art, however, the recess provided in the reverse side of the middle opens at the lower side, that is, the reverse side, and therefore, when the watch is attached to the wrist, the band pivots about the spring bar in such a manner as to twine around the wrist, resulting in problems, for example, incapability of expressing a sense of unity between the band and the middle. In addition, since in the conventional structure the end portion of the band is supported within the recess in the reverse side of the middle, it is impossible to increase an indicator, masking portion which is formed on the obverse side of the middle having the recess formed therein, which imposes a great restriction on designing.

STATEMENT OF OBJECTS

It is an object of the invention to provide an improved fitting structure for a bad and a case of the wristwatch.

Another object of the invention to provide an improved fitting structure for a band and a case of the wristwatch for expressing a sense of unity between the band and the case.

Other and further objects, feature and advantages of the invention will appear more fully from the following description.

SUMMARY OF THE INVENTION

To solve the above-described problems, a recess is formed in a part of the side of the middle which is contiguous with each fitting portion where the band is connected to the middle and a part of the end portion of the band is received and supported within the recess, thereby limiting the pivoting of the first link of the band by the wall of the recess. In addition, a projection is provided in the center of each of the fitting portions formed on the watch case to limit the pivoting of the second link of the band by the distal end of the projection, thereby forming an integral coupling structure for the middle and band.

When the band is coupled to the middle, one end of the band is supported on a band fitting portion provided on the middle through a bar-shaped band retaining member, and the end portion of the band which projects forward from the supported portion is received in the above-described recess with a slight clearance. Thus, when the watch is attached to the wrist, excessive pivoting of the first link of the band is prevented by the wall of the recess and the pivoting of the second link of the band is also prevented by the distal end of the projection formed in the center of the fitting portion of the watch case, thereby expressing a sense of unity between the middle and the band.

DETAILED DESCRIPTION

Figure 1:
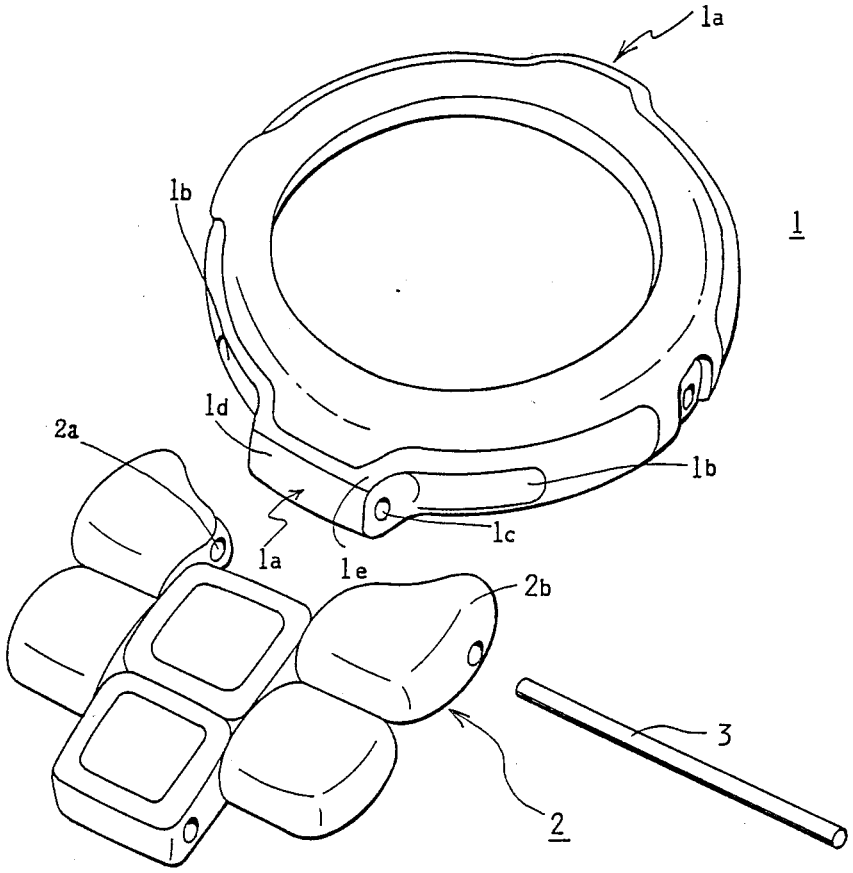
FIG. 1 is an exploded perspective view showing the structure for coupling together a band and a middle according to the present invention and FIG. 2 is an exploded perspective view of a conventional middle.
Figure 2:
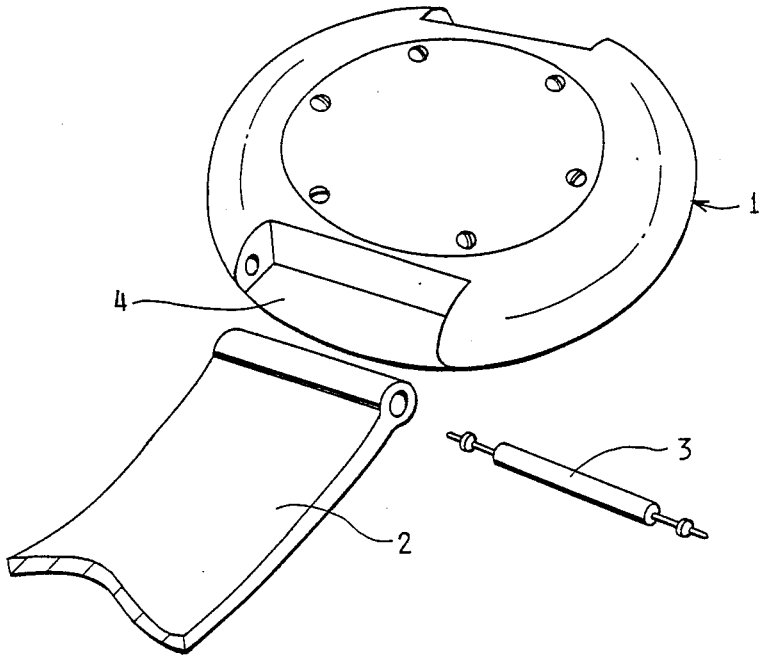

FIG. 1 is an exploded perspective view showing one embodiment of the present invention. In the figure, the reference numeral 1 denotes a middle, a band 2 composed of a plurality of links joined together, and 3 a retaining member used to couple the band 2. The middle 1 is provided with fitting portions 1*a* for coupling together the band and the middle. Each fitting portion la is formed with a projection 1*e*. The side of the projection 1*e* is provided with a bore 1*c* for receiving the retaining member 3 in the form of a bar to support the band. In addition, a recess 1*b* is formed in a portion of the middle which is contiguous with each end of the fitting portion 1*a*. The recess 1*b* is, if necessary, coated with a polymeric material in view of the material of the middle to prevent the middle from being damaged by contact with the band. On the other hand, the first link of the band 2 is formed with a bore 2*a* which communicates with the bore 1*c* in the middle. When the band is engaged with each fitting portion 1*a* of the middle through the retaining member 3, the distal end portion 2*b* of the first link of the band that projects formed from the bore 2*a* is inserted into the corresponding recess 1*b* formed in the middle, so that, when the band is attached to the wrist, the pivoting of the first link of the band about the retaining member and relative to the middle is limited by the distal end portion 2*b* of the first link of the band which abuts against the inner wall of the corresponding recess 1*b*. The distal end 1*d* of the projection le formed on each fitting portion of the middle 1 abuts against the second link of the band, so that the pivoting of the band relative to the watch case is limited within a certain range as far as the second link.

As has been described above, according to the present invention, the end portion of the band is inserted into a recess provided at each side of a projection formed in each fitting portion of the side of the middle where the band is fitted, thereby limiting the pivoting of the band and, in addition, the distal end of the projection is also arranged to abut against a link of the band, thereby synergistically obtaining a sense of unity between the band and the middle. It is also possible to create a variety of designs.

What is claimed is:

1. A fitting structure for a band and a case of a wristwatch comprising:

a watch case having two pairs of fitting recesses formed at respective portions on the side of a middle which face each other and a projection formed in the center of each of said two pairs of fitting recesses;

a band fitted and retained at an end thereof within each of said two pairs of fitting recesses in said watch case through retaining means;

and retaining means for fitting between said band and said watch case.

2. A fitting structure for a band and a case of a wristwatch as claimed in claim 1, wherein said projection formed in each of said pairs of fitting recesses and the end portion of said band which is coupled to said middle in one unit at said projection are formed with respective bores which communicate with each other; said retaining members are inserted into the bores in said middle and said band, thereby coupling said band within said fitting recesses.

3. A fitting structure for a band and a case of a wristwatch as claimed in claim 2, wherein said band end portion is locked by the inner wall of the corresponding fitting recess and a part of said band other than said band end portion is locked by the distal end of the projection provided in the center of said fitting recesses, thereby limiting the pivoting of said band.

* * * * *